US005655514A

United States Patent [19]

Kowald et al.

[11] Patent Number: 5,655,514

[45] Date of Patent: Aug. 12, 1997

[54] FUEL-FIRED FIREPLACE INSERT WITH INTEGRAL COMBINATION DRAFT HOOD AND HEAT EXCHANGER STRUCTURE

[75] Inventors: Glenn W. Kowald, Carrollton; James T. Barth, Plano, both of Tex.

[73] Assignee: Eljer Manufacturing, Inc., Dallas, Tex.

[21] Appl. No.: 607,117

[22] Filed: Feb. 26, 1996

[51] Int. Cl.[6] ..... F24C 3/00

[52] U.S. Cl. ..... 126/531; 126/512; 126/523

[58] Field of Search ..... 126/77, 83, 512, 126/523, 531, 307 A

[56] References Cited

U.S. PATENT DOCUMENTS

| | | | |
|---|---|---|---|
| 4,329,976 | 5/1982 | Jackson | 126/77 |
| 4,896,654 | 1/1990 | Berlaimont | 126/83 |
| 5,191,877 | 3/1993 | Shimek et al. | 126/512 |
| 5,299,558 | 4/1994 | Binzer | 126/512 |
| 5,388,566 | 2/1995 | Smith et al. | 126/512 |
| 5,469,838 | 11/1995 | Broadbent et al. | 126/512 |
| 5,479,915 | 1/1996 | Riener | 126/512 |

FOREIGN PATENT DOCUMENTS

| | | | |
|---|---|---|---|
| 0307038 | 3/1989 | European Pat. Off. | 126/523 |
| 002618526 | 1/1989 | France | 126/523 |

*Primary Examiner*—Carl D. Price

*Attorney, Agent, or Firm*—Catherine E. Bracken; J. Richard Konneker; Marlin R. Smith

[57] ABSTRACT

A fuel-fired fireplace insert has a compact combination heat exchanger/draft hood structure extending interiorly along its top side and opening outwardly through an upwardly extending flue gas outlet and a dilution air inlet disposed on a top front side portion of the insert. During insert operation, hot combustion gas generated within its fire box portion flows upwardly into the interior of the heat exchanger/draft hood structure, is cooled by room air entering the dilution air inlet, and is discharged through the flue gas outlet. At the same time, room air enters the insert through an opening on a lower front side thereof, is heated by being passed externally along the fire box and the combination heat exchanger/draft hood structure, and is then discharged from the insert back into the room through openings adjacent the dilution air opening.

15 Claims, 2 Drawing Sheets

FUEL-FIRED FIREPLACE INSERT WITH INTEGRAL COMBINATION DRAFT HOOD AND HEAT EXCHANGER STRUCTURE

BACKGROUND OF THE INVENTION

The present invention generally relates to heating appliances and, in a preferred embodiment thereof, more particularly relates to fuel-fired fireplace insert apparatus adapted to receive, heat and return air to a room in which the insert apparatus is operatively disposed.

While a wood burning fireplace, during operation thereof, adds visual warmth to the room in which it is disposed it carries with it a well known set of disadvantages such as the periodic necessity of carrying wood to the fireplace from an outside storage area and appropriately stacking it in the fireplace, tending to the fire to keep it going at the desired intensity, emptying and carrying away the ashes created by the use of the fireplace, preventing sparks and embers from being thrown into the room, and periodically removing soot deposits from the interior of the chimney. Additionally, while the typical wood burning fireplace tends to aesthetically warm its room it is far less efficient in actually warming the room, with most of the available wood combustion heat simply going up the chimney.

A conventional alternative to burning real logs in a fireplace is to install a "gas log" assembly in the fireplace interior. A gas log assembly basically includes a stacked arrangement of artificial, noncombustible logs positioned over a gas burner arrangement to which a gaseous fuel, such as natural gas, is piped. When the burner is lit, flames pass upwardly through the noncombustible artificial logs to create the appearance of a natural wood fire in the fireplace. This solves many of the problems associated with natural wood fires, since the artificial logs are not consumed by the flames, do not throw off sparks and embers, do not have to be periodically poked, stoked and otherwise tended, and do not soot up the chimney interior. Additionally, the gas log fire can be instantly started, stopped and adjusted.

However, like its natural log counterpart, the typical gas log assembly is highly inefficient from the standpoint of transferring combustion heat to the room in which it is disposed. A very large percentage of the combustion heat generated by the burning of the continuously supplied gaseous fuel simply goes up the chimney and is wasted to the outside.

In an effort to alleviate this notable shortcoming of the typical gas log assembly, various types of fireplace "inserts" have previously been proposed for installation in existing masonry fireplace openings or into the corresponding fire box opening of a prefabricated factory built fireplace. The typical conventional fireplace insert apparatus is provided in its interior with an appropriate fuel-fired gas log assembly as generally described above, and is further provided with a heating passage through which room air is sequentially received, flowed through into heat exchange contact with hot combustion gases being discharged from the fireplace insert during operation thereof, and then returned to the room as heated supply air.

Thus, a substantial portion of the combustion heat that would otherwise be simply sent up the chimney or flue is efficiently transferred to the room via the heated room air discharged from the fireplace insert. This heating through-flow of room air that traverses the interior of the fireplace insert may be via a natural convection process or created by a forced air circulating fan appropriately installed in the fireplace insert.

Despite their elimination of the gas log and wood-burning fireplace problems mentioned above, conventional fuel-fired fireplace inserts of the recirculating air flow type just described have various well known problems, limitations and disadvantages of their own. These are due primarily to the fact that a conventional fuel-fired fireplace insert of this general type is typically provided with an external draft hood structure projecting upwardly from its top side, and a separate heat exchanger structure disposed on the rear side of the insert.

The placement of the combustion gas-to-recirculated room air heat exchanger structure on the rear side of the fireplace insert either limits the maximum depth of the insert fire box portion, thereby giving it an undesirably "shallower" visual appearance, or undesirably increases the maximum horizontal depth of the insert.

The draft hood portion of the conventional fuel-fired fireplace insert, which is typically external to the insert and projects upwardly beyond its top side, performs three primary functions in the overall operation of the insert. First, it provides an outlet discharge flow path for the hot combustion gases generated in the fire box portion of the insert. Second, it functions to draw in dilution air from the room, for mixture with and cooling of the flue gases being discharged. Third, it functions in a conventional manner as a pressure "buffer" between the outlet vent and the interior of the insert.

To provide adequate room dilution air to this conventionally positioned draft hood structure it is customarily necessary to leave vertical gaps between opposite sides of the installed insert and the corresponding vertical sides of the fireplace opening. This undesirably increases the minimum size of the opening that the insert will fit into. As will be appreciated, it is aesthetically necessary to cover these vertical gaps extending along the opposite sides of the installed insert. However, because of the dilution air flow quantity required to meet the applicable codes and certification standards, it is necessary to use the perforated gap-covering trim structures supplied with the insert—it is typically not feasible to provide custom trim pieces to provide the installed insert with a different appearance.

In view of the foregoing it can readily be seen that a need exists for an improved fuel-fired, heating air recirculating type fireplace insert apparatus that eliminates, or at least substantially reduces, the above-mentioned problems, limitations and disadvantages commonly associated with conventional fuel-fired, heating air recirculating fireplace inserts of the type generally described above. It is accordingly an object of the present invention to provide such improved fireplace insert apparatus.

SUMMARY OF THE INVENTION

In carrying out principles of the present invention, in accordance with a preferred embodiment thereof, a fuel-fired air heating insert apparatus is provided for operative positioning in a fireplace opening and comprises a housing having opposite front and rear sides extending between opposite top and bottom sides. A fire box is disposed within the housing in a vertically spaced relationship with its top and bottom sides, and a forwardly spaced relationship with its rear side.

The fire box forms in the housing an interior air heating passage sequentially extending rearwardly through the front housing side and along a bottom side portion of the fire box, upwardly along a rear side portion of the fire box, forwardly along a top side portion of the fire box, and then outwardly through the front housing side. Fuel-fired burner means are disposed in the fire box and are operative to create a flame and resulting hot combustion gas therein.

According to a key feature of the invention, the insert apparatus also includes combination heat exchanger and draft hood means disposed in the interior air heating passage, between the top side portion of the fire box and the top housing side. The combination heat exchanger and draft hood means are operative to (1) receive hot combustion gas from the fire box and transfer heat from the received hot combustion gas to air flowing forwardly through the interior air heating passage between the top side portion of the fire box and the top housing side, and (2) receive air through the front housing side, mix the received air with the received hot combustion gas to cool it, and then discharge the cooled combustion gas through the top housing side.

In a preferred embodiment thereof, the insert apparatus further comprises a baffle member supported in a top portion of the fire box and forming therewith a combustion gas transfer passage extending interiorly along the top side wall of the fire box, the combustion gas transfer passage having an inlet end positioned adjacent the rear side wall of the fire box, and an outlet end positioned adjacent the front housing side. The combination heat exchanger and draft hood means include a plenum box interposed in the horizontal top portion of the interior air heating passage between the fire box and the top housing side, and dividing such air heating passage portion into separated top and bottom sections.

The plenum box has an open front side disposed at the front housing side to receive ambient dilution air, at least one hollow conduit member communicating a front portion of the combustion gas transfer passage with a front interior portion of the plenum box, and a hollow tubular flue outlet stub portion rearwardly offset from the hollow conduit member and extending upwardly through the top housing side. Preferably, the insert apparatus also includes wall means for forming a combustion air flow path to the burner means, and fan means for creating a forced flow of ambient air through the aforementioned interior air flow passage.

The positioning of the specially designed combination heat exchanger and draft hood means within a top interior portion of the insert apparatus housing provides several advantages over fireplace inserts having separate rear mounted air heat exchanger and top mounted external draft hood structures. For example, the maximum fireplace horizontal opening depth required to receive the insert apparatus of the present invention is advantageously reduced. Moreover, due to the combination of the heat exchanger and draft hood portions of the improved fireplace insert apparatus of the present invention the overall height of the insert is reduced, the heating efficiency of the unit is quite good, and the insert is relatively easy and inexpensive to fabricate.

DETAILED DESCRIPTION

Figure 1:
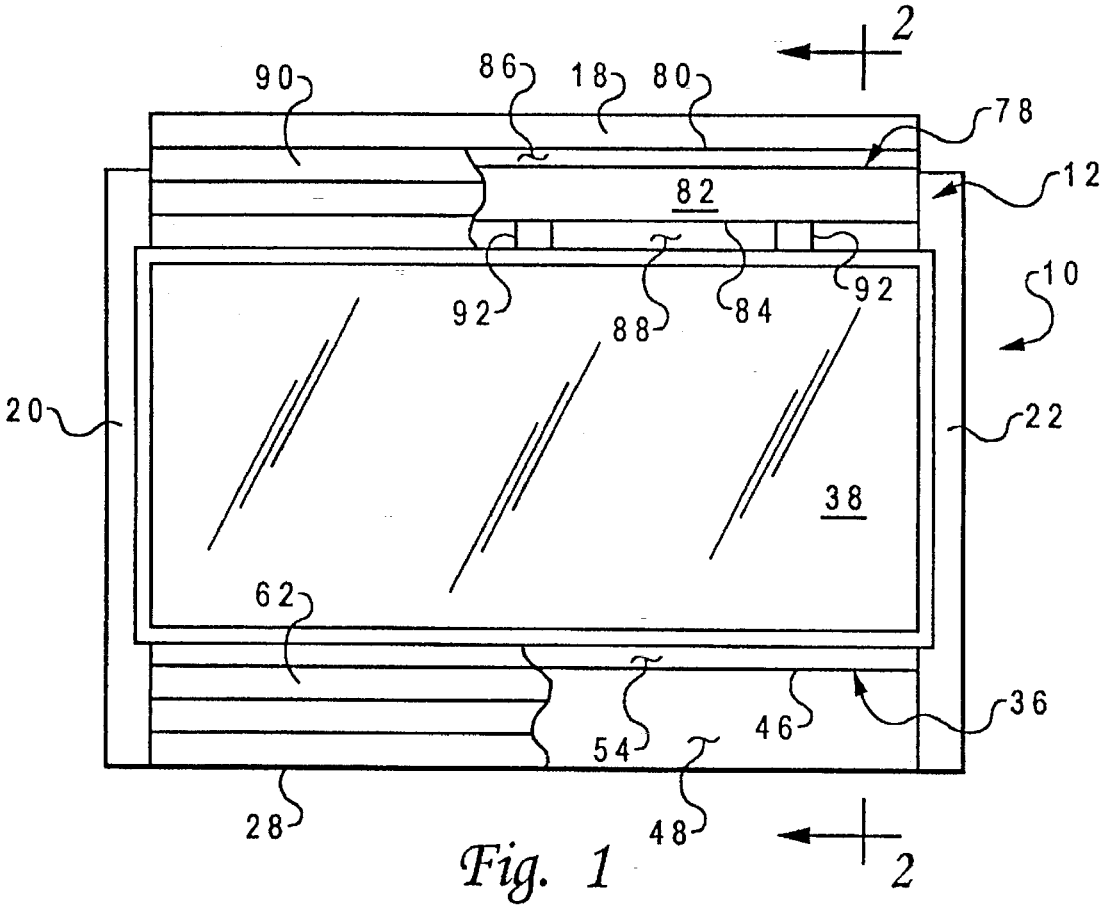
FIG. 1 is a partially cut away, somewhat schematic front side elevational view of a specially designed fuel-fired fireplace insert embodying principles of the present invention.
Figure 3:
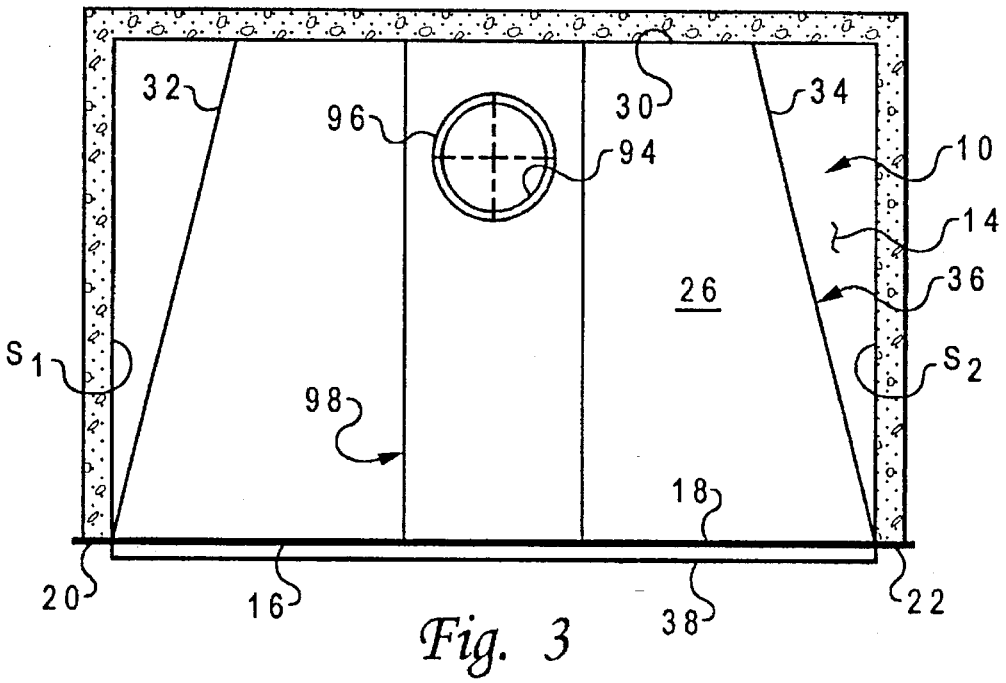
FIG. 3 is a top plan view of the fireplace insert.
Figure 2:
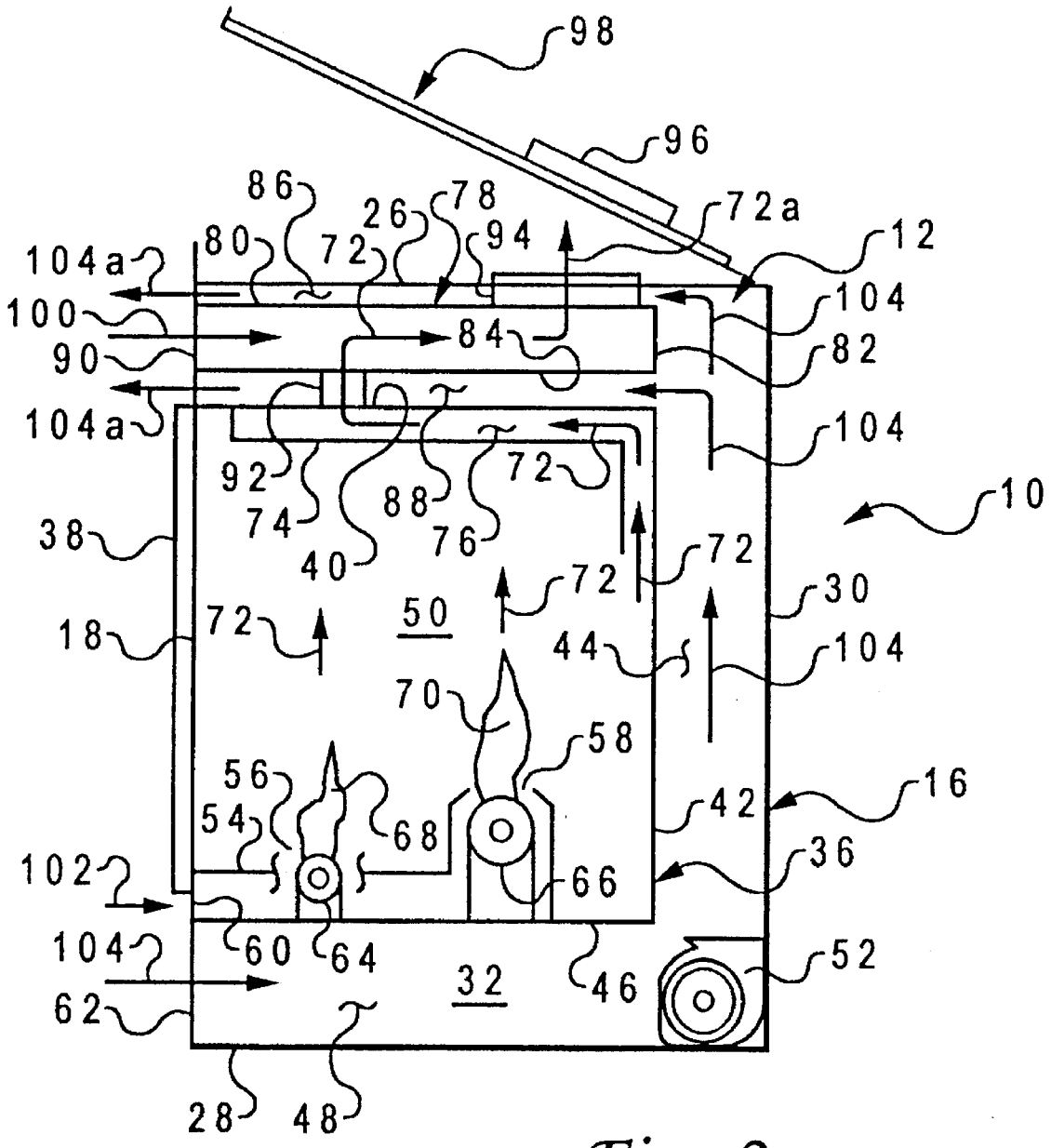
FIG. 2 is a partially exploded cross-sectional view through the fireplace insert taken along line 2—2 of FIG. 1.

As illustrated is somewhat simplified form in FIGS. 1–3, the present invention provides a fuel-fired, heating air recirculating type fireplace insert 10 that incorporates therein a specially designed combination heat exchanger/draft hood structure 12 embodying principles of the present invention. Insert 10 is operatively positionable within an existing masonry fireplace opening 14 (see FIG. 3), or in the opening of a prefabricated fireplace, and includes a sheet metal housing 16 having an open front side 18 partially bordered by outwardly projecting top, left and right side flanges 18,20,22; a horizontal top end wall 26; a horizontal bottom end wall 28; a vertical rear side wall 30; and rearwardly and horizontally inwardly sloping vertical left and right side walls 32 and 34.

Disposed within the interior of the housing 16 is a fire box 36 (see FIG. 2) having an open front side aligned with the open front side 18 of the housing 16 and covered by a framed glass door 38; a top wall 40 spaced downwardly apart from the top wall 26 of the housing 16; a rear side wall 42 spaced forwardly apart from the rear housing wall 30 and forming therewith a vertical interior flow passage 44; a bottom wall 46 spaced upwardly apart from the bottom housing wall 28 and forming therewith a horizontal interior flow passage 48 that communicates with the vertical passage 44 and opens outwardly through the open front side 18 of the housing 16 beneath the glass door 38; and opposite left right vertical side walls 50, only one of which is visible in FIG. 2. For purposes subsequently described herein, a small electric air circulating fan 52 is operatively mounted within the interior of the housing 16 at the juncture of the passages 44,48.

With continued reference to FIG. 2, a raised sheet metal combustion air intake plenum 54 is interiorly disposed within the fire box 36, on its bottom wall 46, and has front and rear top side openings 56 and 58, and a left or front side inlet opening 60 aligned with the open front side 18 of the housing 16. Opening 60, and the underlying open front side of the bottom flow passage 48, is covered by an air inlet louver 62 (see also FIG. 1). The front and rear top side openings 56,58 of the combustion air intake plenum 54 respectively overlie a front gas burner 64 and a larger rear gas burner 66 disposed in the intake plenum 54 and supplied with gaseous fuel via a suitable gas supply manifold pipe (not shown).

During burner operation, flames 68,70 and resulting hot combustion gas 72 are generated within the fire box 36. To provide the appearance of a wood-burning fireplace, an artificial gas log structure (not shown) may be suitably supported above the burners 56,58 within the fire box 36. For purposes later described herein, a sheet metal baffle member 74 is supported within the fire box 36, in a downwardly spaced relationship with its top wall 40, and forms with the interior surface of the fire box a combustion gas transfer passage 76 extending as shown along an upper portion of the fire box 36 and having a vertical inlet portion along the back interior side of the fire box.

The combination heat exchanger/draft hood structure 12 includes a sheet metal plenum box 78 vertically interposed between, and vertically spaced apart from, the top housing wall 26 and the top fire box wall 40. Plenum box 78 has a top wall 80; a rear side wall 82 generally aligned with the rear side wall 42 of the fire box 36; a bottom wall 84; and an open front side aligned with the open front side 18 of the housing 16. The opposing pairs of walls 26,80 and 40,84 respectively form therebetween upper and lower heated air discharge passages 86 and 88 (see also FIG. 1), each of which has an open front side aligned with the open front side 18 of the housing 16, and an open rear side communicating with an upper end of the vertical rear interior passage 44.

An air inlet and outlet louver 90 (see FIGS. 1 and 2), upwardly adjacent the top side of the framed glass door 38, extends over the open front sides of the plenum box 78 and the upper and lower heated air discharge passages 86 and 88. The combustion gas transfer passage 76 is communicated with a front portion of the interior of the plenum box 78 by three spaced apart tubular transfer conduits 92 interconnected between the top fire box wall 40 and the bottom plenum box wall 84 and extending vertically through thee lower heated air discharge passage 88. One of the conduits 92 is visible in FIG. 2, and two of the conduits 92 are visible in FIG. 1.

Near the right or rear side of the plenum box 78 is a tubular flue outlet stub 94 (see FIG. 2) that communicates with the interior of the plenum box 78, projects upwardly from its top wall 80, and extends upwardly through the top wall 26 of the housing 16. The stub 94 has an open upper end and is coaxially received within a tubular portion 96 of a removable flue collar structure 98 positioned atop the upper housing wall 26 as best illustrated in FIG. 3. Tubular flue collar portion 96 is connectable to an upwardly projecting exhaust gas discharge stack (not illustrated).

During operation of the fireplace insert 10, the hot combustion gas 72 generated within the fire box 36 flows into and horizontally through the combustion gas transfer passage 76 above the baffle member 74, and then upwardly into a front portion of the interior of the plenum box 78 via the transfer conduits 92. At the same time, room air 100 is drawn into the open front side of the plenum box 78 (via the upper louver 90) and mixes with and cools the hot combustion gas 72 entering the plenum box 78 via the vertical transfer conduits 92 to form diluted, cooled combustion gas **72*a* which upwardly exits the housing 16 via the flue outlet stub 94. The plenum box 78 thus functions, within the interior of the fireplace insert 10, as an integral draft hood structure in conjunction with the previously mentioned exhaust stack (not illustrated) connected to the flue collar 96**.

According to a key aspect of the present invention, the plenum box 78 also functions as an integral combustion gas/recirculated room air heat exchanger within the interior of the fireplace insert 10. Specifically, during operation of the fireplace insert 10, a second quantity 102 of room air (see FIG. 2) is drawn rearwardly into the interior of the air intake plenum structure 54, via the lower louver 62, to provide combustion air for the fuel burners 56 and 58. At the same time, a third quantity 104 of room air is drawn rearwardly into the bottom interior passage 48, via the lower louver 62, by the operation of the fan 52. The entering room air 104 is forced by the fan 52 upwardly through the vertical rear interior passage 44 and then forwardly through the upper and lower air discharge passages 86 and 88, whereby heat from both the fire box 36 and the plenum box 78 is transferred to the air 104 which is then flowed outwardly through the upper louver 90 in the form of upper and lower streams of heated supply air **104*a* discharged from the upper and lower air passages 86 and 88. While the illustrated fireplace insert 10 provides a forced flow of recirculated room air through its interior using the fan 52, if desired the fan 52** can be eliminated to permit a convective flow of room air through the interior of the insert.

As can be seen in FIGS. 2 and 3, the unique combination in the present invention of the heat exchanger and draft hood portions of the insert integrally within a top interior portion of the housing 16 provides several advantages over conventionally configured inserts in which the draft hood portion is disposed externally above the housing, and the heat exchanger portion is disposed externally behind the housing. For example, as best illustrated in FIG. 3, this unique integration of a combination heat exchanger/draft hood structure into a top interior portion of the insert housing permits the front side of the housing to extend essentially completely between the opposite sides $S_1$ and $S_2$ of the fireplace opening 14 without the usual necessity of leaving dilution air intake gaps between opposite front side portions of the housing and the opposite sides of the opening 14. Accordingly, a variety of custom side trim structures may be utilized in conjunction with the insert 10.

Additionally, since the circulating air heat exchange structure is integrated with the draft hood structure, and positioned within a top interior portion of the housing 16, the maximum front-to-rear distance of the fireplace opening 14 required to accept the insert 10 is advantageously reduced. Moreover, due to the combination of the heat exchanger and draft hood portions of the insert 10 described above, the overall height of the insert is reduced, the heating efficiency of the unit is quite good, and the insert 10 is relatively easy and inexpensive to fabricate.

The foregoing detailed description is to be clearly understood as being given by way of illustration and example only, the spirit and scope of the present invention being limited solely by the appended claims.

What is claimed is:

1. A fuel-fired room air heating insert structure operatively positionable within a fireplace opening, comprising:

a housing having opposite front and rear sides extending between opposite top and bottom sides;

a fire box supported within said housing and having a horizontal top side wall spaced downwardly apart from said top side of said housing, and a vertically extending rear side wall perpendicularly joined to said top side wall of said fire box;

a burner disposed within said fire box and operative to receive gaseous fuel from a source thereof and create therefrom a flame and resulting hot combustion gas;

an interior air heating passage having (1) an inlet opening disposed at said front housing side between said fire box and said bottom housing side, (2) a bottom portion extending rearwardly from said inlet opening between said fire box and said bottom housing side, (3) a rear portion extending upwardly from said bottom portion between said rear side wall of said fire box and said rear housing side, (4) a top portion extending forwardly from said rear portion between said top side wall of said firebox and said top housing side, and (5) an outlet opening disposed at said front housing side between said top side wall of said fire box and said top housing side; and a combination heat exchanger/draft hood structure disposed substantially in its entirety between said horizontal top side wall of said fire box and said top side of said housing and including a plenum box disposed in said top portion of said air heating passage in the path of air flowing outwardly therethrough, said plenum box having a dilution air inlet opening disposed at said front housing side, a hot combustion gas inlet portion communicating the interiors of said fire box and said plenum box, and a cooled combustion gas outlet portion extending through said top housing side.

2. The insert structure of claim 1 further comprising:

a circulating fan disposed within said housing and operative to create a forced flow of room air through said interior air heating passage from said inlet opening thereof to said outlet opening thereof.

3. The insert structure of claim 2 wherein:

said circulating fan is disposed generally at the juncture of said bottom and rear portions of said interior air heating passage.

4. The insert structure of claim 1 wherein:

said burner is disposed on a bottom interior portion of said fire box, and said insert structure further comprises a combustion air intake plenum structure extending along said bottom interior portion of said fire box and partially enveloping said burner, said combustion air intake plenum structure having a top side outlet opening disposed over said burner, and a front inlet opening positioned at said front housing side.

5. The insert structure of claim 1 wherein:

said hot combustion gas inlet portion of said plenum box includes at least one combustion gas transfer conduit member interconnected between an underside portion of said plenum box and a top side portion of said fire box.

6. The insert structure of claim 5 wherein:

said at least one combustion gas transfer conduit member is forwardly offset from said cooled combustion gas outlet portion of said plenum box.

7. The insert structure of claim 6 wherein:

said fire box has a top side wall and a rear side wall, said insert structure further comprises a baffle member supported in a top portion of said fire box and forming therewith a combustion gas transfer passage extending interiorly along said top side wall of said fire box, said combustion gas transfer passage having an inlet end positioned adjacent said rear side wall of said fire box, and an outlet end positioned adjacent said front housing side, and each of said at least one combustion gas transfer conduit member is interconnected between an outlet end portion of said combustion gas transfer passage and an interior portion of said plenum box disposed forwardly of said cooled combustion gas outlet portion of said plenum box.

8. The insert structure of claim 1 wherein:

said plenum box is interposed in said top portion of said interior air heating passage in a manner such that said plenum box divides said top portion into a top section thereof extending along a top side of said plenum box and a bottom section thereof extending along a bottom side of said plenum box.

9. The insert structure of claim 1 wherein:

said fire box has an open front side, and said insert structure further comprises a glass door positioned over said open front side of said fire box.

10. The insert structure of claim 1 wherein:

said housing has rearwardly and horizontally inwardly sloping opposite left and right sides interconnected between said front and rear housing sides.

11. The insert structure of claim 1 further comprising:

a first air transfer louver extending along a top portion of said front housing side over said interior air heating passage outlet opening, and a second air transfer louver extending along a bottom portion of said front housing side over said interior air heating passage inlet opening.

12. The insert structure of claim 1 wherein:

said cooled combustion gas outlet portion is a tubular flue outlet stub extending upwardly through said top housing wall, and said insert structure further comprises a removable flue collar structure disposed externally disposed on said top housing wall and having a tubular flue collar receiving said flue outlet stub and being connectable to a flue stack structure.

13. Fuel-fired fireplace insert apparatus comprising:

a housing having opposite front and rear sides extending between opposite top and bottom sides;

a fire box disposed within said housing in a vertically spaced relationship with said top and bottom sides of said housing, and a forwardly spaced relationship with its rear side, said fire box having a horizontally extending top side wall and forming in said housing an interior air heating passage sequentially extending rearwardly through said front housing side and along a bottom side portion of said fire box, upwardly along a rear side portion of said fire box, forwardly along and above said horizontally extending top side wall of said fire box, and then outwardly through said front housing side;

fuel-fired burner means disposed in said fire box and being operative to create a flame and hot combustion gas therein; and combination heat exchanger and draft hood means disposed substantially in their entirety between said horizontally extending top side wall of said fire box and said top housing side, and being interposed in said interior air heating passage and operative to:

(1) receive hot combustion gas from said fire box and transfer heat from the received hot combustion gas to air flowing forwardly through said interior air heating passage between said top side portion of said fire box and said top housing side, and (2) receive air through said front housing side, mix the received air with the received hot combustion gas to cool it, and then discharge the cooled combustion gas through said top housing side.

14. A fuel-fired room air heating insert structure operatively positionable within a fireplace opening, comprising:

a housing having opposite front and rear sides extending between opposite top and bottom sides;

a fire box supported within said housing and having a horizontally extending top side wall spaced downwardly apart from said top side of said housing and a vertically extending rear side wall perpendicularly joined to said top side wall of said fire box;

a burner disposed within said fire box and operative to receive gaseous fuel from a source thereof and create therefrom a flame and resulting hot combustion gas;

an interior air heating passage having (1) an inlet opening disposed at said front housing side between said fire box and said bottom housing side, (2) a bottom portion extending rearwardly from said inlet opening between said fire box and said bottom housing side, (3) a rear portion extending upwardly from said bottom portion between rear side wall of said fire box and said rear housing side, (4) a top portion extending forwardly from said rear portion between said top side wall of said fire box and said top housing side, and (5) an outlet opening disposed at said front housing side between said top side wall of said fire box and said top housing side;

a combination heat exchanger/draft hood structure disposed substantially in its entirety between said top side wall of said fire box and said top side of said housing and including a plenum box disposed in said top portion of said air heating passage in the path of air flowing outwardly therethrough, said plenum box having a dilution air inlet opening disposed at said front housing side, a hot combustion gas inlet portion communicating the interiors of said fire box and said plenum box, and a cooled combustion gas outlet portion extending through said top housing side; and a baffle member supported in a top portion of said fire box and forming therewith a combustion gas transfer passage extending interiorly along said top side wall of said fire box, said combustion gas transfer passage having an inlet end positioned adjacent said rear side wall of said fire box, and an outlet end positioned adjacent said front housing side, said hot combustion gas inlet portion of said plenum box including at least hollow combustion gas transfer conduit member forwardly offset from said cooled combustion gas outlet portion of said plenum box and being interconnected between an outlet end portion of said combustion gas transfer passage and an interior portion of said plenum box disposed forwardly of said cooled combustion gas outlet portion of said plenum box.

15. The insert structure of claim 14 wherein:

said plenum box is interposed in said top portion of said interior air heating passage in a manner such that said plenum box divides said top portion into a top section thereof extending along a top side of said plenum box and a bottom section thereof extending along a bottom side of said plenum box.

* * * * *